US008528626B2

(12) United States Patent
Zenpo et al.

(10) Patent No.: US 8,528,626 B2
(45) **Date of Patent: *Sep. 10, 2013**

(54) METHOD FOR FORMING MOLDS AND A CORE FOR CASTING METAL

(75) Inventors: Toshihiko Zenpo, Toyokawa (JP); Yusuke Kato, Toyokawa (JP); Norihiro Asano, Toyokawa (JP); Masahiko Nagasaka, Toyokawa (JP); Kazuyuki Nishikawa, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/373,002

(22) Filed: Nov. 2, 2011

(65) Prior Publication Data

US 2012/0048503 A1 Mar. 1, 2012

Related U.S. Application Data

(62) Division of application No. 10/570,273, filed as application No. PCT/JP2004/012553 on Aug. 31, 2004.

(30) Foreign Application Priority Data

| | | |
|---|---|---|
| Sep. 2, 2003 | (JP) | 2003-309473 |
| Mar. 31, 2004 | (JP) | 2004-101685 |
| May 6, 2004 | (JP) | 2004-137791 |

(51) Int. Cl.
*B22C 1/20* (2006.01)
*B22C 1/26* (2006.01)

(52) U.S. Cl.
USPC ..... 164/527; 164/520; 164/521; 164/522

(58) Field of Classification Search
USPC ..... 164/20–22, 520–529; 106/38.2–38.9; 523/139
See application file for complete search history.

(56) References Cited

U.S. PATENT DOCUMENTS 4,330,459 A * 5/1982 Takahashi et al. ..... 523/148
4,487,868 A * 12/1984 Armbruster et al. ..... 524/44

(Continued)

FOREIGN PATENT DOCUMENTS

CH 226 493 4/1943
FR 1 342 529 11/1963

(Continued)

OTHER PUBLICATIONS

JPO machine translation of JP 2000-190049, Jul. 11, 2000.*

*Primary Examiner* — Kevin P Kerns
*Assistant Examiner* — Kevin E Yoon
(74) *Attorney, Agent, or Firm* — Finnegan, Henderson, Farabow, Garrett & Dunner, L.L.P.

(57) ABSTRACT

The present inventions provide a method for forming molds and a core which generates no gases with bad effects on the human bodies while the binders are heated. In particular, the present inventions provide a method for forming molds and a core comprising an aggregate material mixture consisting of granular aggregate materials, wherein the aqueous binders and water are foamed with stirring, filled into a space for forming molds, and caked with an evaporating water component. In an embodiment, molds can be further cured by adding cross linking agents before and after they are taken out from the space for forming. Further, an aggregate material mixture for forming molds used for the method for forming molds of the present inventions is provided.

6 Claims, 2 Drawing Sheets

(56) References Cited

U.S. PATENT DOCUMENTS

| | | | | |
|---|---|---|---|---|
| 4,867,228 | A * | 9/1989 | Novelli et al. | 164/525 |
| 5,758,708 | A * | 6/1998 | Beckwith et al. | 164/21 |

FOREIGN PATENT DOCUMENTS

| | | |
|---|---|---|
| FR | 1 451 754 | 1/1966 |
| FR | 1 473 665 | 3/1967 |
| FR | 1 524 000 | 5/1968 |
| FR | 1 540 511 | 9/1968 |
| FR | 1 597 758 | 6/1970 |
| FR | 1 597 807 | 6/1970 |
| FR | 2 038 456 | 1/1971 |
| FR | 2 054 805 | 5/1971 |
| FR | 2 059 675 | 6/1971 |
| FR | 2 074 662 | 10/1971 |
| FR | 2 105 073 | 4/1972 |
| FR | 2 147 786 | 3/1973 |
| FR | 2 180 486 | 11/1973 |
| GB | 1 086 241 | 10/1967 |
| GB | 1 361 027 | 7/1974 |
| GB | 1 430 841 | 4/1976 |
| GB | 1 431 483 | 4/1976 |
| JP | 55008328 | 1/1980 |
| JP | 59047043 | 3/1984 |
| JP | 63115649 | 5/1988 |
| JP | 9-108809 | 4/1997 |
| JP | 10193033 | 7/1998 |
| JP | 2000190049 | 7/2000 |

* cited by examiner

METHOD FOR FORMING MOLDS AND A CORE FOR CASTING METAL

This application is a divisional of U.S. application Ser. No. 10/570,273 filed Mar. 2, 2006, which is a §371 of International Application No. PCT/JP2004/012553 filed Aug. 31, 2004 and claims priority of Japanese applications No. 2003-309473, filed Sep. 2, 2003; No. 2004-101685, filed Mar. 31, 2004; and No. 2004-137791, filed May 6, 2004, the contents of all of which are incorporated herein by reference.

FIELD OF THE INVENTIONS

The present inventions are related to a method for forming molds by which little gas with discomforting odors and bad effects on human bodies is generated while binders are heated when materials for forming molds that include binders are formed and when melted metal is poured using a core for casting formed of materials for forming molds that include binders, and to a core for casting metal produced by the method for forming molds. Further, the present inventions are related to an aggregate material mixture for forming molds using the method for forming molds of the inventions.

BACKGROUND OF THE INVENTIONS

Phenol resins are used as caking additives in Example 1 of the method for forming molds shown in the Official Gazette of Japanese Patent Early publication (Kokai) No. Hei. 05-32148, and volatile gases such as formaldehyde, phenol and ammonia are generated when binders are cured by the heat of formed dies. The gases generated cause discomforting odors and have bad effects on human bodies. Or water glasses are used as in Example 2, and it is not preferable that molds after casting become refuse, because they cannot be recycled.

Also, a so-called forming method for shell molds, in which sand coated with binders is blown and filled in heated dies for forming and the filled binders coated with sand are cured by the heat of the dies, is disclosed in the Official Gazette of Japanese Patent Early-publication (Kokai) No. Hei. 10-193033.

Volatile gases such as formaldehyde, phenol, and ammonia are generated when binders are cured by the heat of the dies in the method for forming shown in the references of the patent. The gases generated cause discomforting odors and have bad effects on human bodies. Also, when these dies are used for casting, for example, aluminum alloys and resin binders are not fully volatilized or decomposed, because the pouring temperature into molds is about 700° C. As a result, a core may not be easily removed from cast metal after the cast metal is cooled. Further, a water jacket core for producing aluminum castings for automobile engines is complicated in shape and is very thin. Thus, if the binders in the core are not completely baked and decomposed by the heat conduction from the poured and melted metal, it is difficult to remove the core sand from the castings.

Further, as shown in the Official Gazette of Japanese Patent Early-publication (Kokai) No. Sho. 59-47043, it is not preferable that a caking additive composition using multi-functional aldehyde, glyoxal, urea, etc., as cross linking agents be used for casting, because they may generate toxic gases such as formaldehyde.

Also, it is very difficult to continuously fill mixtures in a blow head into molds by the method for forming molds shown in the Official Gazette of Japanese Patent Early-publication (Kokai) No. Sho. 55-8328, because the unit particles of silica sand in the blow head aggregate to become bulky because of the method when casting sand that is combined with binders mainly composed of water and aqueous binders frozen and the frozen mixture is blow-filled into molds or during the period that lasts until the second blow-filling is done. Thus, these kinds of methods for forming molds have not been practically used.

Further, when a core for casting using aqueous binders is left under a high humidity, the core may be deformed and not maintain its shape because the aqueous binders generally absorb water and their bonds are weakened. There has been a problem in that water vapor is generated when the water component is heated and it induces bubbles when pouring metal, though the poured metal can be used for casting.

DISCLOSURE OF THE INVENTIONS

The present inventions were accomplished based on the above problems. First, the inventions provide a method for forming molds which generates little gas with discomforting odors or bad effects on human bodies while binders are heated when materials for forming molds, including binders, are formed and when casting metal is poured using a core for casting formed of materials for forming molds, including binders, and provide a core produced by the method for forming molds.

Second, the inventions provide the method for forming molds by which an aggregate mixture including binders and sand can be fully filled in detailed parts in a space for forming molds and a core produced by the method for forming molds.

Also, third, the inventions provide a core for casting metals which can be easily removed after poured and melted metal is cooled. Namely, the inventions provide a core for casting metals in which binders are volatilized or decomposed by the heat of poured and melted metal and which can be easily removed after the poured and melted metal is cooled. When nonferrous alloys, for example, aluminum alloys, are used for the core. the pouring temperature into molds is about 700° C. and below the pouring temperature of iron-system materials, of about 1400° C.

Fourth, the inventions provide a method for forming molds by which a core for casting metals formed of an aggregate material mixture that includes sand and binders can maintain its shape under high humidity and provide a core produced by this method for forming molds.

Fifth, the inventions provide a core for metals such as iron-system metals, copper alloys, etc., of which the pouring temperatures are higher than those for aluminum alloys.

In one embodiment, the inventions provide a method for forming molds characterized in foaming an aggregate material mixture by stirring an aggregate material mixture composed of granular aggregate materials, aqueous binders and water, filling the foamed aggregate material mixture into a space for forming molds, evaporating the water component in the aggregate material mixture, caking the aggregate material mixture, forming molds, and then taking out the formed mold from the space for forming molds.

In another embodiment, the inventions provide a method for forming molds characterized in foaming an aggregate material mixture by stirring an aggregate material mixture composed of granular aggregate materials, aqueous binders, cross linking agents that induce a cross linking reaction with the aqueous binders and water, filling the foamed aggregate material mixture in a space for forming molds, then taking out the formed mold from the space for molding molds after evaporating the water component of the aggregate material mixture in the space for forming molds and causing a cross linking reaction with the aqueous binders and the cross linking agents.

In another and further embodiment, the inventions provide a method for forming molds characterized in foaming an aggregate material mixture by stirring an aggregate material mixture composed of granular aggregate materials, aqueous binders, cross linking agents inducing a cross linking reaction with the aqueous binders and water, filling the foamed aggregate material mixture in a space for forming molds, taking out the formed mold from the space for forming molds after evaporating the water component of the aggregate material mixture in the space for forming molds, and causing a more complete cross linking reaction with the aqueous binders of the formed mold that has been taken out.

Also, the inventions provide a core produced by the method for forming molds of the inventions.

Further, the inventions provide an aggregate material mixture for forming molds preferable for the use in the method for forming molds of the inventions. The aggregate material mixture for forming molds is characterized in being foamed to be a whipped cream in which granular aggregate materials are equally dispersed.

BRIEF DESCRIPTIONS OF THE FIGURES

PREFERABLE EMBODIMENTS FOR CARRYING OUT THE INVENTIONS

Figure 1:
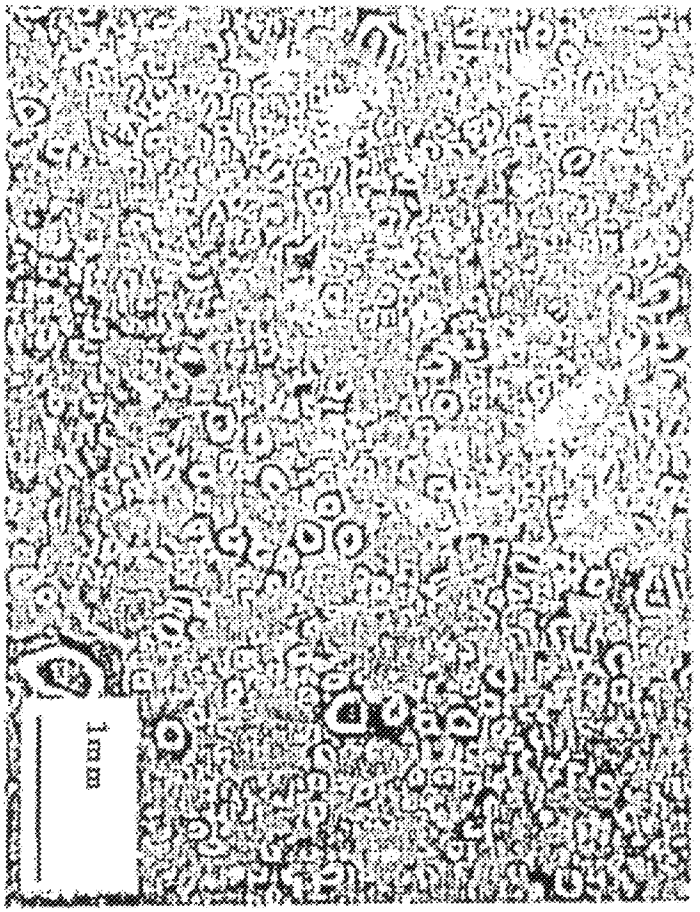
FIG. 1 shows the foamed aggregate mixture foamed by stirring.

The method for forming molds of the inventions is characterized in having a process of mixing granular aggregate materials, one or more kinds of aqueous binders (further adding cross linking agents according to the case) and water, a process of foaming an aggregate material mixture by stirring an aggregate material mixture, a process of filling the foamed aggregate material mixture in a space for forming molds, a process, of evaporating the water component in the mixture, caking the aggregate and forming molds, a process taking out the formed mold from the space for forming molds, and according to the case a process of causing a cross linking to occur before or after the process of taking out.

The granular aggregate materials in the inventions consist of more than one material chosen from silicate sand, aluminum sand, olivin sand, chromite sand, zircon sand, mullite sand, and various kinds of artificial aggregate materials, etc.

The one or more kinds of aqueous binders in the inventions are caking additives which may be caked by evaporating the water component and contain saccharides and resins etc.

Also, it is preferable to use the aqueous ones at ordinary temperature. The aqueous binders which are aqueous at ordinary temperature can be mixed without heating the aqueous binders and water when producing the aggregate material mixture with adding water. But the aqueous binders insoluble in water cannot be mixed with water without heating.

However, the aqueous binders which cannot be mixed with water can also be used if they would be aqueous in the water in the situation wherein they are cooled to ordinary temperature after they are mixed with water.

In the inventions, a core can be easily removed from poured and melted metal because the binders are easily volatilized and decomposed when melted metal is poured in the core produced by the method for forming molds of the inventions by using the aqueous binders.

As the aqueous binders used for the inventions, one or more kinds with a saponification degree of 80-90 mole % of polyvinyl alcohols or their derivatives, starch or its derivatives, saponins, or saccharides, are preferable. Those of which the degree of saponification is more than 95 mole % and not more than 99 mole %, and are soluble in hot water, can also be used. Here, a saponification degree of 80-95 mole % of polyvinyl alcohols or their derivatives, alpha-starch, dextrin or their derivatives, saponins, or sugar, are soluble in water at ordinary temperature. Specific examples of polyvinyl alcohol derivatives are polyvinyl alcohols having acetic acid groups, carboxyl groups, lactic acid groups, silanol groups, etc. Specific examples of starch are alpha-starch and dextrin derived from potato, corn, tapioca, and wheat, etc. Specific examples of starch derivatives are etherilificated, esterificated, and cross-linked starches. The aqueous binders used for the inventions are easy to obtain, and, in particular, alpha-starch and dextrin are cheap. Also, the saccharides include polysaccharides, di-saccharides, and mono-saccharides. In the specification the term "poly-saccharides" includes any vegetable poly-saccharides soluble in water at ordinary temperature (but, they do not include cellulose).

The content of the soluble binders is preferably 0.1-5.0 weight parts compared to 100 weight parts of aggregate materials. Formed molds having enough strength cannot be obtained with less than 0.1 weight parts of aqueous binders. Molds obtained show excess strength with more than 5.0 weight parts of aqueous binders. Also, as the binders of the inventions, polyvinyl alcohols and saponins are superior from the point of easily foaming and starches and saccharides are superior from the point of not generating discomforting odors. So formed molds are practically done with the proper arrangement of the ratio by which they [their contents] are combined.

In the method of containing cross linking agents in an aggregate material mixture while adding more cross linking agents according to the case and cross-linking cross linking agents and aqueous binders in the inventions, cross linking reactions are enhanced by heating the cross linking agents. Thus, the bonds between the granular aggregate materials of the aqueous binders are strengthened, the reactions between the aqueous binders and water molecules hardly occur, and molds formed of the aggregate materials can sufficiently maintain their properties even in high humidity.

The cross linking agents used in the inventions are: compounds having carboxylic groups which cross-link by means of ester-bonding, such as oxalic acid, maleic acid, succinic acid, citric acid, and butanetetracarboxylic acid; and compounds which would have carboxylic groups in an aqueous solution, such as methylvinylether-maleic anhydride copolymers and isobutylene-maleic anhydride copolymers. Also, as the cross linking agents used in the inventions, those cross linking agents that bond with ester-bonding generate little toxic gases during the formation of molds or pouring melted metal, that is, the cross linking agents having carboxyl groups are preferable.

The amount of the cross linking agents added to be used in the inventions is at least 5 weight % versus aqueous binders, and preferably 5-300 weight %. If the amount of the cross linking agents versus aqueous binders is less than 5 weight %, the effect by the cross-linking is not enough, and the formed mold cannot maintain enough strength under high humidity. Also, if the amount of the cross linking agents versus aqueous binders is more than 300 weight %, the effect is not different from that of 300 weight %, so the addition of more than an amount of 300 weight % of the cross linking agents is not economical, and is unpreferable.

The cross linking agents are used as aqueous solutions in the inventions and preferably used as more than 5 weight % concentrations of aqueous solutions when, for example, butanetetracarboxylic acid, citric acid and methylvinyl ether-maleic anhydride are used.

The cross linking reaction of the inventions can be carried out either before or after taking out formed molds from a space for forming molds. When the cross linking reaction is carried out after taking out formed molds from the space for forming molds, the reaction would be done at higher temperatures for shorter times, as for example, under the atmosphere at 220° C. for about 20 minutes and under the atmosphere at 250° C. for about 10 minutes.

The process of the inventions in which the mixture containing granular aggregate materials, one or more kinds of aqueous binders (cross linking agents are added according to the case) and water, is carried out using, for example, a stirrer.

In the method for forming the molds of the inventions, in the process of foaming by stirring, the mixture of the aggregate materials is stirred so that foaming air would be equally dispersed, preferably with the foaming ratio of 50-80%. Foaming is bad with a foaming ratio of 50%, and the strength is not sufficient with a foaming ratio of not less than 80%. According to this, the effect for the aggregate material mixture to flow when it is filled under pressure into the space for forming molds is obtained (FIG. 1). The granular aggregate material mixture is equally dispersed as a whipped cream by this foaming. In the description of the inventions, "foaming" means the period of 10 seconds occurring after the stirring procedure stops, which preferably occurs in the aggregate material mixture when it is stopped for more than 15 seconds with a foaming ratio of 50-80%.

Here, the ratio of foaming was calculated by the following formula.

Ratio of Foaming(%)={(Total Volume of the Mixture)−Volume of Granular Aggregate Material, Aqueous Binder,and Water}/(Total Volume of the Mixture)}×100

Further, the stirring for foaming may be done either by the same stirrer as that for mixing or by another stirrer. The foamed air generated by stirring is equally dispersed in the mixture.

In the present inventions, the method for filling the foamed aggregate material mixture in the space for forming molds may be by either the method of placing the foamed aggregate material mixture in a cylinder and pressing it directly or the method of pressing by air.

Here, "pressing it directly by a cylinder" means pressing the mixture in the cylinder (means for storing the mixture) into a die by the manner of press fitting of the direct pressing by the press fitting of the piston with a pressing mechanism. "Pressing by air" means the method of supplying compressed air (air) to the upper surface of the mixture in the means for storing the mixture when press fitting the mixture into a die with a cover, which cover airtightly closes the opening at the top of the means for storing the mixture and is connected to a compressed air source provided at the bottom of the piston rod of the cylinder with the pressing mechanism, instead of the piston in the method of press fitting the mixture in the means for storing the mixture by the piston with the pressing mechanism.

In the process of evaporating a water component in the filled aggregate material mixture, caking the aggregate material mixture, and forming molds by the method for forming molds of the present inventions, the method of evaporating the water component consists of evaporating the water component by a die, set at a high temperature, which defines the space for forming molds, radiating heated water vapor or microwaves, leaving the mold in the vacuum atmosphere, and ventilating the space for forming molds according to the needs, etc.

In evaporating at a high temperature the water component by a die that defines the space for molding molds, dispersed bubbles in the aggregate material mixture and the water component in the binders gather in the central part of the molds by means of stirring by the heat of the heated die, so molds of which the central part is low in the density of the packed aggregate materials are obtained. If the mold is used for casting, it becomes easy to eject the gases etc. derived from the decomposition of the binders because the amount of the binders is small because of the low density of the central part and because the part of the hole of the mold is large.

The cores for casting metal of the present inventions are obtained from forming by the method for forming molds. When the aqueous binders used in the present inventions are used for casting nonferrous metal alloys such as aluminum alloys or magnesium, alloys to form a core for casting, the core is easily removed after the binders are volatilized or decomposed and the poured and melted metal is cooled, though the pouring temperature in the mold is about 700° C. and a lower pouring temperature than the pouring temperature of iron-system materials of 1400° C.

Also, when the core for casting of the present inventions is used for casting iron-system metals, normal poured and melted iron-system metal is made by coating the surface of the core. And a mold can also be ejected and removed.

Further, in the core for casting metal of the present inventions, the gases generated during the production and usage of the core for casting metal substantially do not have discomforting odors, but have the odor of baking biscuits.

Also, for the preservation of the binder solutions when cross linking agents are used, preferable is keeping separately two kinds of polyvinyl alcohols or their derivatives and the other binders, and mixing both of them at the time of use.

EXAMPLES

The method for forming molds of the present inventions is specifically explained in the following.

(Process of Mixing and Stirring 1)

To granular aggregate material of 100 weight parts and aqueous solutions comprising a binder component of 0.1-5.0 weight parts in relation to this granular aggregate material is added water, of which the weight parts and the weight parts of the aqueous binders are 1-20 weight parts. They are stirred by a stirrer to foam the aggregate material mixture at the ratio of foaming of 50-80%.

(Process of Mixing and Stirring 2)

To granular aggregate material of 100 weight parts, aqueous solutions comprising a binder component of 0.1-5.0 weight parts in relation to this granular aggregate material, and more than 10 weight % of an aqueous solution of 5-100 weight % of cross linking agents in relation to the aqueous binders, is added water of which the weight parts, the weight parts of the aqueous binders, and the weight parts of the aqueous solution of the cross linking agents, are 1-20 weight part. They are stirred by a stirrer to foam the aggregate material mixture at a ratio of foaming of 50-80%.

(Process of Casting)

Figure 2:
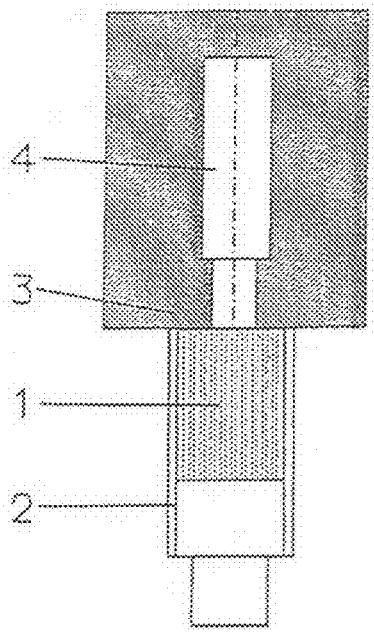
FIG. 2 shows a longitudinal front elevation view of an apparatus for forming molds for carrying out the inventions. Mark 1 shows a mixture, Mark 2 shows a cylinder, Mark 3 shows a die for forming molds, and Mark 4 shows a cavity in the Figure.

Next, a process of forming is explained based on FIG. 2. The mixture 1 obtained in the process of mixing and stirring is input into a cylinder 2. Then the cylinder 2 is extended, the aggregate material mixture 1 is filled in a cavity 4 of a die for forming molds 3, which cavity is set up at the upper part of the cylinder 2 and is maintained at 200-280° C., a water component of the filled aggregate material mixture is evaporated and caked, and a formed mold is taken out from the cavity 4 of the die for forming molds 3 after a cross linking reaction has taken place. Or, when the cross linking reaction in the die for molding molds 3 is not sufficient, the formed mold that is taken out is put in an incubator maintained at a temperature wherein the aqueous binders and cross linking agents cause a sufficient cross linking reaction, preferably at 200-300° C. for a time sufficient for the cross linking reaction, preferably for 10-40 minutes. Then the formed mold is taken out from the incubator after a sufficient cross linking reaction has taken place.

Example 1

Silica sand (Fluttery Sand) of 100 weight parts, polyvinyl alcohol of (JP-05: Nihon Sakubi-Poval) of 0.2 weight parts, starch (DextrinNSD-L: Nisshi) of 0.8 weight parts, citric acid (Fuso Kagaku) of 0.2 weight parts, and water of 5 weight parts, are mixed with stirring, foamed at 200 rpm for about 3 minutes by a mixer (Aikousha Desktop Mixer), and the results of the ratio of foaming of the aggregate material mixture measured. The results according to the other conditions are shown in Table 1. Also, a CCD photo of the aggregate material mixture of Test No. 1 is shown in FIG. 1.

TABLE 1

| | Aqueous Binder | | | | Cross Linking Agent | | | |
|---|---|---|---|---|---|---|---|---|
| Test No. | Species | Amount of Addition (weight parts) | Species | Amount of Addition (weight parts) | Species | Amount of Addition (weight parts) | Water Component (%) | Ratio of Foaming (%) |
| 1 | JP-05 | 0.2 | NSD-L | 0.8 | Citric acid | 0.4 | 4.7 | 63.7 |
| 2 | JP-05 | 0.2 | NSD-L | 0.8 | Citric acid | 0.4 | 6.9 | 69.2 |
| 3 | JP-05 | 0.2 | NSD-L | 0.8 | Citric acid | 0.4 | 4.3 | 62.5 |
| 4 | Saponin | 0.2 | NSD-L | 1.0 | Citric acid | 0.8 | 5.0 | 58.5 |
| 5 | Saponin | 0.2 | NSD-L | 1.0 | Citric acid | 0.8 | 8.0 | 61.3 |
| 6 | Saponin | 0.3 | NSD-L | 1.0 | Citric acid | 0.8 | 5.8 | 65.3 |
| 7 | Saponin | 0.3 | NSD-L | 1.0 | Citric acid | 0.8 | 9.2 | 72.0 |

Bubbles are equally and sufficiently distributed in the aggregate material mixture shown in FIG. 1. Also, the aggregate material mixture of the conditions of Test Nos. 1-7 in Table 1 (hereafter, the explanation refers to FIG. 2) are put in the cylinder 2, filled with pressure to about 70 $cm^3$ of the volume of the cavity 4, which is maintained at 250° C. by an electric cartridge heater of a die 3 for forming molds in a cylinder, and at a surface pressure of 0.5 MPa of an air cylinder, retained for 2 minutes, the water component of the aggregate material mixture is evaporated and caked, and then the formed mold is taken out from the cavity 4 of the die for forming molds 3 to obtain a formed mold which can be sufficient for its use.

Example 2

Silica sand (Fluttery Sand) of 100 weight parts, polyvinyl alcohol (JP-05: Nihon Sakubi-Poval) of 0.2 weight parts, starch (DextrinNSD-S: Nichiden Kagaku) of 0.8 weight parts, butanetetracarboxylic acid (Rikacid BT-W: Shinnihon Rika) of 0.2 weight parts, and water of 5 weight parts, were mixed with stirring, foamed at about 200 rpm for about 3 minutes by a mixer (Aikousha Desktop Mixer) (hereafter, the explanation refers to FIG. 2), about 80 g of the aggregate material mixture was put in the cylinder 2, a pressure of about 70 $cm^3$ of the volume of the cavity 4 was set, which was maintained at 220° C. by an electric cartridge heater of a die 3 for forming molds in a cylinder with a surface pressure of 0.5 MPa of an air cylinder, kept for 3 minutes, the water component of the aggregate material mixture was evaporated and caked, and then the formed mold was taken out from the cavity 4 of the die for forming molds 3. Then, the formed mold was put in an incubator maintained at 220° C. for 40 minutes, reacted with cross linking, and then taken out from the incubator. A test of pouring melted metal was done with this formed mold as a core of the die for casting. An aluminum alloy was poured at the pouring temperature of 710° C. and no casting defects occurred. Also, when melted metal was poured at the pouring temperature of 710° C., the binders were volatilized and decomposed and the core could be easily removed after the poured and melted metal was cooled. Also, no discomforting odors were generated during the forming and pouring, and the odors were like those from biscuits being baked.

Example 3

An ethanol-system coating reagent (Threecoat MTS-720A: Mikawa Kousan Co. Ltd.) was coated on the mold obtained by the same method for forming to give a core for casting, and a test of pouring melted metal was carried out. Cast iron (FCD450) was poured at the pouring temperature of 1370° C. to give an excellent poured and melted metal without discomforting odors, any casting defects, or generation of deformations. Also, a core could be easily removed from the poured and melted metal.

Example 4

Silica sand (Fluttery Sand) of 100 weight parts, polyvinyl alcohol (JP-05: Nihon Sakubi-Poval) of 0.2 weight parts, starch (DextrinNSD-L: Nisshi) of 0.8 weight parts, citric acid (Fuso Kagaku) of 0.2 weight parts, and water of 5 weight parts, were mixed with stirring, foamed at about 200 rpm for about 3 minutes by a mixer (Aikousha Desktop Mixer) (hereafter, the explanation refers to FIG. 2) about 90 g of the aggregate material mixture was put in the cylinder 2, a pressure of about 80 $cm^3$ of the volume of the cavity 4 was set, which was maintained at 220-270° C. by an electric cartridge heater of a die 3 for forming molds in a cylinder with a surface pressure of 0.5 MPa of an air cylinder, kept for 1-3 minutes, the water component of the aggregate material mixture was evaporated and caked, and then the formed mold was taken out from the cavity 4 of the die for forming molds 3. Test templates (10×10×L60) were made from this formed mold and the results measured of the packing densities and the flexural strength of the test templates kept in the incubator under a humidity of 30%. The test templates kept in the incubator under a humidity of 98% for 24 hours are shown in Table 2.

TABLE 2

| | Aqueous Binder | | Cross Linking Agent | | | | | Flexural Strength (MPa) | |
|---|---|---|---|---|---|---|---|---|---|
| Test No. | Species | Amount of Addition (weight parts) | Species | Amount of Addition (weight parts) | Metal Temperature (° C.) | Retention Time in the Die (min) | Packing Density (g/$cm^3$) | Humidity 30% | Humidity 98% × after 24 hrs |
| 1 | JP-05 Polyvinyl alcohol | 0.2 | Citric acid | 0.4 | 220 | 1 | 1.22 | 2.9 | 0.46 |
| | NSD-L Dextrin | 0.8 | | | | | | | |
| 2 | JP-05 | 0.2 | Citric acid | 0.4 | 220 | 2 | 1.21 | 3.6 | 1.39 |
| | NSD-L | 0.8 | | | | | | | |
| 3 | JP-05 | 0.2 | Citric arid | 0.4 | 220 | 3 | 1.23 | 3.9 | 1.46 |
| | NSD-L | 0.8 | | | | | | | |
| 4 | JP-05 | 0.2 | Citric acid | 0.4 | 250 | 1 | 1.23 | 4.2 | 1.7 |
| | NSD-L | 0.8 | | | | | | | |
| 5 | JP-05 | 0.2 | Citric acid | 0.4 | 250 | 2 | 1.24 | 3.9 | 1.9 |
| | NSD-L | 0.8 | | | | | | | |
| 6 | JP-05 | 0.2 | Citric acid | 0.4 | 250 | 3 | 1.24 | 3.9 | 1.9 |
| | NSD-L | 0.8 | | | | | | | |
| 7 | JP-05 | 0.2 | Citric acid | 0.4 | 270 | 1 | 1.20 | 3.7 | 1.94 |
| | NSD-L | 0.8 | | | | | | | |
| 8 | JP-05 | 0.2 | Citric acid | 0.4 | 270 | 2 | 1.22 | 3.8 | 2.57 |
| | NSD-L | 0.8 | | | | | | | |
| 9 | JP-05 | 0.2 | Citric acid | 0.4 | 270 | 3 | 1.21 | 3.1 | 1.94 |
| | NSD-L | 0.8 | | | | | | | |

It is found from Table 2 that the strength in regards to the flexural strength of the formed molds kept in the incubator under a humidity of 30% for 24 hours is assured under the conditions of Table 2 to be used for molds. However, at the die temperature of 220° C., the strength under a humidity of 98% after 24 hours is low even for the retention time in the die of 3 minutes. Since the cross linking reaction is not sufficient in the die under this condition, it is necessary to treat the mold with cross linking under a temperature of 220° C. for about 20 minutes, or under a temperature of 250° C. for about 10 minutes after taking out the die.

When the temperature of the die is 250-270° C., the strength after 24 hours at a humidity of 98% for the retention time in the die of 1 minute is sufficient for use as molds, so no cross linking treatment after taking a mold from the die is necessary.

Example 5

Silica sand (Fluttery Sand) of 100 weight parts, polyvinyl alcohol (JP-05: manufactured by Nihon Sakubi-Poval) of 0.3 weight parts, sugar (manufactured by Fuji Nihon Seito) of 1.0-2.0 weight parts, citric acid (manufactured by Fuso Kagaku) of 0.4-1.2 weight parts, and water of 5 weight parts, were mixed with stirring, foamed at about 200 rpm for about 3 minutes by a mixer (Desktop Mixer manufactured by Aikousha) (hereafter, the explanation refers to FIG. 1), about 90 g of the aggregate material mixture was put in the cylinder 2, a pressure of about 80 $cm^3$ of the volume of the cavity 4 was set, which was maintained at 250° C. by an electric cartridge heater of a die 3 for forming molds in a cylinder with a surface pressure of 0.5 MPa of an air cylinder, kept for 1-3 minutes, the water component of the aggregate material mixture was evaporated and caked, and then the formed mold was taken out from the cavity 4 of the die for forming molds 3. Test templates (10×10×L60) were made from this formed mold and the results measured of the packing densities and the flexural strength of the test templates kept in the incubator under a humidity of 30% for 24 hours are shown in Table 3.

TABLE 3

| Test No. | Aqueous Binder Species | Aqueous Binder Amount of Addition (weight parts) | Cross Linking Agent Species | Cross Linking Agent Amount of Addition (weight parts) | Metal Temperature (° C.) | Retention Time in the Die (min) | Packing Density (g/cm$^3$) | Flexural Strength (MPa) Humidity 30% × after 24 hrs |
|---|---|---|---|---|---|---|---|---|
| 1 | JP-05 Polyvinyl alcohol | 0.3 | Citric acid | 0.4 | 250 | 2 | 1.18 | 3.86 |
| | Sugar | 1.0 | | | | | | |
| 2 | JP-05 Polyvinyl alcohol | 0.3 | Citric acid | 0.8 | 250 | 2 | 1.28 | 5.77 |
| | Sugar | 1.5 | | | | | | |
| 3 | JP-05 Polyvinyl alcohol | 0.3 | Citric acid | 1.2 | 250 | 2 | 1.35 | 8.17 |
| | Sugar | 2.0 | | | | | | |

Example 6

Silica sand (Fluttery Sand) of 100 weight parts, polyvinyl alcohol (JP-05: manufactured by Nihon Sakubi-Poval) of 0.2 weight parts, starch (Dextrin NSD-100: manufactured by Nissi) of 0.8 weight parts, and water of 5 weight parts, were mixed with stirring, foamed at about 200 rpm for about 3 minutes by a mixer (Desktop Mixer manufactured by Aikousha) (hereafter, the explanation refers to FIG. 2), about 90 g of the aggregate material mixture was put in the cylinder 2, a pressure of about 80 cm$^3$ of the volume of the cavity 4 was set, which was maintained at 220° C. by an electric cartridge heater of a die 3 for forming molds in a cylinder with a surface pressure of 0.5 MPa of an air cylinder, kept for 3 minutes, the water component of the aggregate material Mixture was evaporated and caked, and then the formed mold was taken out from the cavity 4 of the die for forming molds 3. Test templates (10×10×L60) were made from this formed mold and the results measured of the packing densities and the flexural strength of the test templates kept in the incubator under a humidity of 30% and the test templates kept in the incubator under a humidity of 98% for 24 hours are shown in Table 4.

It is found from Table 4 that the strength in regards to the flexural strengths of the formed molds kept in the incubator under a humidity of 30% for 24 hours are assured under the conditions of Table 1, to be used for molds. It is found that the strengths in regards to the flexural strength of the formed molds kept in the incubator under a humidity of 98% for 24 hours by adding cross linking agents are assured sufficiently to be used for molds.

Example 7

Silica sand (Fluttery Sand) of 100 weight parts, saponin (reagent: manufactured by Kishida Kagaku) of 0.2 weight parts, starch (Dextrin NSD-L: manufactured by Nissi) of 0.8 weight parts, citric acid (manufactured by Fuso Kagaku) of 0.4 weight parts, and water of 6 weight parts, were mixed with stirring, foamed at about 200 rpm for about 3 minutes by a mixer (Desktop Mixer, manufactured by Aikousha) (hereafter, the explanation refers to FIG. 2), about 90 g of the aggregate material mixture was put in the cylinder 2, a pressure of about 80 cm$^3$ of the volume of the cavity 4 was set, which was maintained at 250° C. by an electric cartridge heater of a die 3 for forming molds in a cylinder with a surface pressure of

TABLE 4

| Test No. | Aqueous Binder Species | Aqueous Binder Amount of Addition (weight parts) | Cross Linking Agent Species | Cross Linking Agent Amount of Addition (weight parts) | Packing Density (g/cm$^3$) | Flexural Strength (MPa) Humidity 30% | Flexural Strength (MPa) Humidity 98% × after 24 hrs |
|---|---|---|---|---|---|---|---|
| 1 | JP-05 Polyvinyl alcohol | 0.8 | — | — | 1.25 | 3.0 | not more than 0.5 |
| 2 | JP-05 Polyvinyl alcohol | 0.2 | — | — | 1.22 | 2.8 | not more than 0.5 |
| | NSD-100 Dextrin | 0.8 | | | | | |
| 3 | JP-05 Polyvinyl alcohol | 0.8 | Butane-tetra-carboxylic acid | 0.2 | 1.26 | 3.2 | 1.9 |
| 4 | JP-05 Polyvinyl alcohol | 0.2 | Citric acid | 0.4 | 1.19 | 3.7 | 2.3 |
| | ND-S Dextrin | 0.8 | | | | | |

0.5 MPa of an air cylinder, kept for 2 minutes, the water component of the aggregate material mixture was evaporated and caked, and then the formed mold was taken out from the cavity 4 of the die for forming molds 3. Test templates (10×10×L60) were made from this formed mold and the results measured of the packing densities and of the flexural strength of the test templates kept in the incubator under a humidity of 30%. The test templates kept in the incubator under a humidity of 98% for 24 hours are shown in Table 5.

TABLE 5

| | Aqueous Binder | | | | Cross Linking Agent | | | Flexural Strength (MPa) | |
|---|---|---|---|---|---|---|---|---|---|
| Test No. | Species | Amount of Addition (weight parts) | Species | Amount of Addition (weight parts) | Species | Amount of Addition (weight parts) | Packing Density (g/cm$^3$) | Humidity 30% | Humidity 98% × after 24 hrs |
| 1 | Saponin | 0.8 | — | — | — | — | 1.22 | Not more than 1.0 | Not more than 0.5 |
| 2 | Saponin | 0.8 | — | — | Citric acid | 0.8 | 1.24 | 1.53 | 1.33 |
| 3 | Saponin | 0.2 | NSD-L | 0.8 | Citric acid | 0.4 | 1.21 | 2.81 | 1.41 |
| 4 | Saponin | 0.2 | NSD-L | 1.0 | Citric acid | 0.8 | 1.16 | 2.99 | 1.70 |
| 5 | Saponin | 0.3 | NSD-L | 1.0 | Citric acid | 0.3 | 1.19 | 3.41 | 1.96 |

It is seen from Table 2 that the strength in regards to the flexural strength of the formed molds kept in the incubator under a humidity of 30% for 24 hours using a saponin as aqueous binders also definitely have the conditions of tests Nos. 2-5 necessary to be used for molds. However, when the saponin of No. 1 alone was used, the strength was not more than 1.0 MPa. When cross linking agents were added to the saponins as Nos. 2-5, it was found that a cross linking reaction occurred, and a strength sufficient to be used under a humidity of 98% after 24 hours was shown.

Example 8

Figure 3:
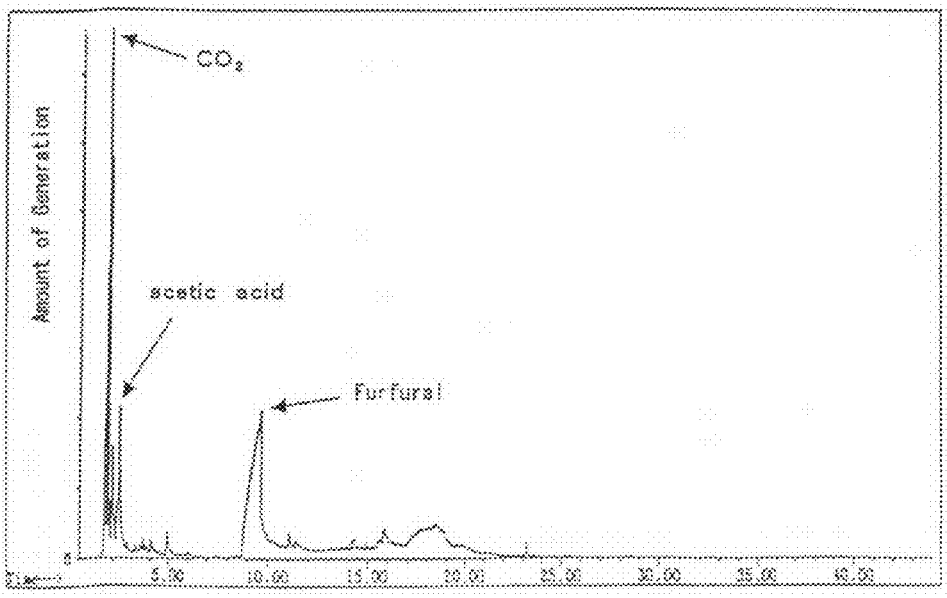
FIG. 3 shows the results of the analyses of the components of gases generated from the binders of the inventions by a mass spectrometer.

A mixture of which the ratio of the contents of polyvinyl alcohol (JP-05: manufactured by Nihon Sakubi-Poval), starch (DextrinND-S: manufactured by Nisshi), and citric acid (Fuso Kagaku) was 1:4:2 was put in an incubator for 10 minutes. The mixture when taken out was left under a helium atmosphere in a heat decomposition oven at 590° C. for 5 seconds. Then gases generated by the heat decomposition were passed through a column (after being kept at 50° C. for 10 minutes, the temperature was raised to 240° C. at the rate of 10° C./min and kept for 15 minutes) and the species of the gases were analyzed by a mass spectrometer. FIG. 3 shows the results of the analyses of the components of the gases generated from the binders of the present inventions, by that mass spectrometer. As a result, carbon dioxide, acetic acid, and furfural were detected (FIG. 3).

Example 9

Silica sand (Fluttery Sand) of 100 weight parts, polyvinyl alcohol (JP-05: manufactured by Nihon Sakubi-Poval) of 0.2 weight parts, starch (Dextrin NSD-L: manufactured by Nissi) of 0.8 weight parts, citric acid (manufactured by Fuso Kagaku) of 0.4 weight parts, and water of 5 weight parts, were mixed with stirring, foamed at about 200 rpm for about 3 minutes by a mixer (Desktop Mixer, manufactured by Aikousha) (hereafter, the explanation refers to FIG. 1), about 90 g of the aggregate material mixture was put in the cylinder 2, a pressure of about 80 cm$^3$ of the volume of the cavity 4 was set, which was maintained at 250° C. by an electric cartridge heater of a die 3 for forming molds in a cylinder at a surface pressure of 0.5 MPa of an air cylinder, kept for 2 minutes, and the water component of the aggregate material mixture was evaporated, caked, and reacted with cross linking and then the formed mold was taken out from the cavity 4 of the die for molding the molds 3. Test templates (10×10×L60) were made from this formed mold. The results of the measurements of the bulk density and the amount of binders of each part are shown in Table 6.

TABLE 6

| Position measured (position from surface) | Bulk Density [g/cm$^3$] | Amount of Binders [%] |
|---|---|---|
| 0-1 mm | 1.68 | 2.5 |
| 4-5 mm | 0.97 | 0.8 |

It is found that the core of a mold (4-5 mm from surface) is low in bulk density and small in the amount of binders compared to the surface (0-1 mm from the surface).

INDUSTRIAL APPLICABILITY

At the stage of pouring melted metal of the processes of the forming and casting, excellent effects are accomplished in that few toxic gases are generated, the formed molds can be easily removed from poured and melted metal after the pouring, and the ability to fill the die for forming molds is good. Further, anti-humidity can be accomplished by a cross linking of the aqueous binders and by cross linking agents.

The invention claimed is:

1. A method for forming molds comprising:

(a) foaming an aggregate material mixture by stirring the aggregate material mixture containing granular aggregate materials, 0.1-5.0 weight parts of one or more kinds of aqueous binders per 100 weight parts of the granular aggregate materials, and water, wherein the stirred mixture has a ratio of foaming of 50-80%, the ratio of foaming being defined by:

Ratio of Foaming(%)={(Total volume of the Mixture)−Volume of Granular Aggregate Materials, Aqueous Binders,Cross linking agent and water/(Total Volume of the Mixture)}×100;

(b) filling the foamed aggregate material mixture under pressure in a space for forming molds;

(c) caking the aggregate material mixture by evaporating the water in the filled aggregate material mixture under heat and forming a mold; and (d) taking out the formed mold from the space for forming molds wherein the aqueous binders are selected from the group consisting of the combination of polyvinyl alcohol or its derivatives and starch or its derivatives, the combination of saponins and starch or its derivatives, and the combination of polyvinyl alcohol or its derivatives, and saccharides selected from the group consisting of polysaccharides, disaccharides and monosaccharides.

2. The method for forming molds according to claim 1, wherein the foamed aggregate material mixture is filled in the space for forming molds under pressure by directly pressurizing the mixture by press fitting of a piston in a cylinder in step (b).

3. The method for forming molds according to claim 1, wherein the foamed aggregate material mixture is filled in the space for forming molds under pressure by providing compressed air to a cylinder in step (b).

4. The method for forming molds according to claim 1, wherein the water in the filled aggregate material mixture is evaporated by the heat of a heated die that forms the space for forming molds in step (c).

5. The method for forming molds according to claim 1, wherein the aqueous binders are soluble in water at ordinary temperature.

6. The method for forming molds according to claim 1, wherein at least one kind of the aqueous binders is foamable.

* * * * *